United States Patent [19]

Simo

[11] 4,159,241

[45] Jun. 26, 1979

[54] PROCESS FOR REMOVING ARSENIC AND/OR ANTIMONY FROM OIL SHALE DISTILLATE OR COAL OIL

[75] Inventor: Thomas Simo, Bad Homburg, Fed. Rep. of Germany

[73] Assignee: Metallgesellschaft Aktiengesellschaft, Frankfurt am Main, Fed. Rep. of Germany

[21] Appl. No.: 836,468

[22] Filed: Sep. 26, 1977

[30] Foreign Application Priority Data
Oct. 4, 1976 [DE] Fed. Rep. of Germany ..... 2644721

[51] Int. Cl.[2] ..... C10G 23/00
[52] U.S. Cl. ..... 208/251 H
[58] Field of Search ..... 208/251 H, 107, 253

[56] References Cited

U.S. PATENT DOCUMENTS

| | | | |
|---|---|---|---|
| 2,065,201 | 12/1936 | Szayna | 208/107 |
| 2,956,004 | 10/1960 | Conn et al. | 208/251 H |
| 3,494,855 | 2/1970 | Stine et al. | 208/107 |
| 4,029,571 | 6/1977 | Curtin | 208/251 H |

*Primary Examiner*—George Crasanakis

[57] ABSTRACT

An improvement in a process of removing arsenic and/or antimony from their chemical compounds in a substantially organic liquid by treating the latter with hydrogen under a superatmospheric pressure and at an elevated temperature, the improvement residing in applying this process to the liquid distillate of oil shale or coal or one derived from the gasification of coal, said liquid containing oil shale dust or coal dust whereby elementary arsenic and/or antimony is deposited on said oil shale dust or said coal dust and said oil shale dust or said coal dust containing elementary arsenic and/or antimony is removed therefrom.

3 Claims, No Drawings

PROCESS FOR REMOVING ARSENIC AND/OR ANTIMONY FROM OIL SHALE DISTILLATE OR COAL OIL

BACKGROUND OF THE INVENTION

1. Field of the Invention

This invention relates to a process for removing arsenic and/or antimony from substantially organic liquids. This invention is particularly concerned with the removal of arsenic and/or antimony from substantially organic liquids derived from the distillation of oil shale or coal or obtained through the gasification of coal, the organic liquid containing oil shale dust or coal dust upon which the arsenic or antimony will be deposited.

This invention is concerned with the treatment of such organic liquid with hydrogen under a superatmospheric pressure and at an elevated temperature and the subsequent removal of the elementary arsenic and/or antimony—together with the oil shale or coal dust solids from the liquid.

2. Discussion of the Prior Art

In a known process of removing combined or elementary arsenic from liquids which have become available as a result of the gasification of solid coal or of the distillation of oil shale or coal, solids, such as oxides or sulfides or iron, cobalt, or nickel, are admixed, the mixture is treated with hydrogen at elevated temperature and superatmospheric pressure, the arsenic is permitted to deposit on the admixed solids, and the composite solid particles are removed (U.S. Pat. No. 3,933,624).

This process has the disadvantage that an extraneous solid must be admixed to provide a support for the arsenic which is to be removed. The particle size of the solid to be added must be controlled to enable the solids to be slurried in the liquid to be treated.

It is an object of the invention to avoid these and other disadvantages of the prior art and to provide a process by which arsenic and/or antimony can be removed in a simple manner from substantially organic liquids which have become available as a result of the distillation of oil shale or coal or of the gasification of coal.

SUMMARY OF THE INVENTION

Broadly, this invention contemplates an improvement in the recovery of antimony and/or arsenic from a substantially organic liquid which has become available through distillation of oil shale or coal or through gasification of coal, by treatment with hydrogen at an elevated temperature and pressure, the improvement residing in applying the aforesaid treatment to a substantially organic liquid which contains oil shale dust or coal dust whereby elementary arsenic and/or antimony thus formed is permitted to deposit on the solids and the dust-elementary metal solid composite is thereafter removed.

According to a further feature of the invention, the treatment with hydrogen is carried out at a pressure of 60 to 160 bars and a temperature of 300° to 500° C.

The advantages offered by the invention reside particularly in that a simple process is provided in which arsenic and/or antimony can be removed from substantially organic liquids which have become available as a result of the distillation of oil shale or coal or of the gasification of coal. Within the scope of the invention, the solid which is inherently contained in the liquid is used as a support for the arsenic and/or antimony which is to be removed so that extraneous solids need not to be added to the liquid to be processed.

The process according to the invention can be carried out continuously without need for a fixed bed as a support for the impurities to be removed. Such bed would have to be regenerated in batch operation.

Further advantages of the process according to the invention reside in that the H/C ratio in the liquid to be processed can be increased so that the liquid is subjected to a preliminary hydrogenation and its viscosity is reduced.

The invention results in an increase of the particle size of the solids so that their subsequent removal is facilitated.

Under the conditions used in accordance with the invention, no carbon is lost by a deposition of oil coke on the surfaces of the solids because the treatment with hydrogen is carried out within a short residence time and at a relatively low temperature.

EXAMPLE 500 grams of condensate obtained by the distillation of oil shale and having a solids content of 35.3% by weight and an initial boiling point of 220° C. and boiling to an amount of 85% at 550° C. are hydrogenated in a 2-liter stirred autoclave. Under a pressure of 120 bars, the autoclave is fed with technically pure $H_2$ and is heated to 400° C. with stirring. The residence time of the charge at 400° C. is 15 minutes, with constant stirring. This is followed by rapid cooling. $H_2$ is passed through the autoclave at a rate of 100 standard liters per hour. Under these conditions, the purity of the withdrawn $H_2$ does not decrease below 90%.

For examination, part of the shale oil condensate is subsequently filtered, the filter cake is washed with toluene to remove residual oil and is dried.

| Results | |
|---|---|
| Solids content of feed condensate | 35.3% by weight |
| Arsenic content of solids in feed condensate | 25 ppm |
| Oil content of feed condensate | 64.7% by weight |
| Arsenic content of the oil phase of the feed condensate | 31 ppm. |

After the treatment, the solids contain 65 ppm arsenic and the residual arsenic content of the oil phase is less than 1 ppm.

What is claimed is:

1. A process for removing a metal selected from the group consisting of arsenic, antimony and mixtures thereof from an oil shale distillate containing shale dust or a coal oil distillate containing coal dust which consists essentially of contacting said oil shale distillate or said coal oil distillate with hydrogen under a pressure of 60 to 160 bars at a temperature of 300° to 500° C. and at a residence time of about 15 minutes and rapidly cooling the so-treated distillate whereby elementary arsenic, antimony or mixture thereof is deposited on said oil shale dust or said coal dust and said oil shale dust or said coal dust containing elementary arsenic, antimony or mixture thereof is removed therefrom, the residual arsenic content of the oil phase remaining being less than 1 ppm and such oil phase being obtained without any carbon loss.

2. A process according to claim 1 wherein the substantially organic liquid which is treated contains arsenic.

3. A process according to claim 1 wherein the substantially organic liquid which is treated contains antimony.

* * * * *